United States Patent [19]

Frye

[11] Patent Number: 5,056,657

[45] Date of Patent: Oct. 15, 1991

[54] DISPLAY CASE FOR A FOLDED MEMORIAL FLAG

[76] Inventor: Lawrence Frye, 1902 Spillertown Rd., Marion, Ill. 62959

[21] Appl. No.: 607,708

[22] Filed: Nov. 1, 1990

[51] Int. Cl.[5] ..... B65D 25/00

[52] U.S. Cl. ..... 206/45.34; 206/494

[58] Field of Search ..... 206/494, 45.34; 40/124.5

[56] References Cited

U.S. PATENT DOCUMENTS

| | | | |
|---|---|---|---|
| D. 30,428 | 3/1899 | Hamburger . | |
| D. 68,491 | 10/1925 | Nevius . | |
| D. 77,674 | 2/1929 | Crucet . | |
| D. 87,221 | 6/1932 | Klie . | |
| D. 89,425 | 3/1933 | Horner . | |
| D. 275,080 | 8/1984 | Sun . | |
| 1,920,882 | 8/1933 | Pellow | 206/45.34 |
| 2,616,473 | 11/1952 | Katz et al. . | |
| 3,561,146 | 2/1971 | Dembar . | |

FOREIGN PATENT DOCUMENTS

| | | | |
|---|---|---|---|
| 1524555 | 4/1968 | France | 206/45.34 |
| 2376041 | 9/1978 | France | 206/45.34 |

OTHER PUBLICATIONS

Photograph of Display Case at George Mason University Law School (No date available).

Advertisement of Loving Memories Display Case Appearing in The Retired Officer Magazine, Jan. 91, p. 60.

Brochure of Loving Memories Display Case, Flagcase Company (copyright 1989).

*Primary Examiner*—William I. Price

*Attorney, Agent, or Firm*—Beveridge, DeGrandi & Weilacher

[57] ABSTRACT

A displaying case for a folded memorial flag which is self supporting and is dimensioned and arranged to maintain the folded memorial flag in a centered position. The casing includes a transparent front facing and either an opaque or transparent backing member. The front facing and backing member are spaced a distance apart which sufficiently compresses the folded memorial flag into a centered position between the front facing and backing member. Side edges are provided around the periphery of both the front facing and backing member to ensure relative positioning. The casing is preferably in a pentagonal shape so as to essentially conform to the configuration of the folded flag while maintaining a symmetrical design. The backing member is also preferably secured to the siding edge in a releasable manner so as to enable withdrawal of a folded flag contained within the casing.

18 Claims, 2 Drawing Sheets

FIG. 6
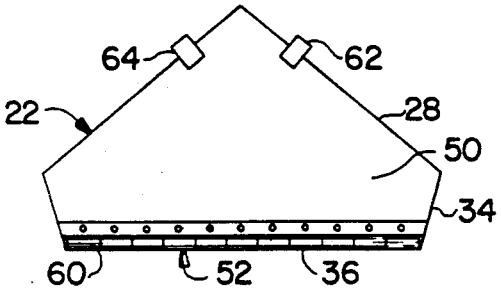
FIG. 7A
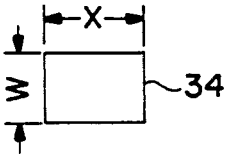
FIG. 7B
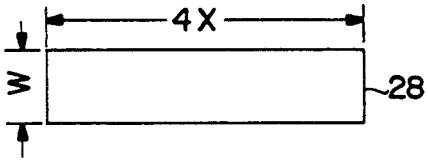
FIG. 7C
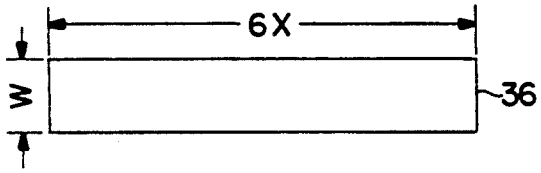
FIG. 8A
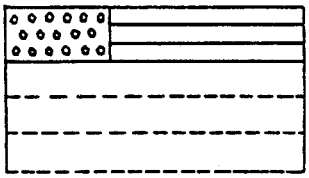
FIG. 8B
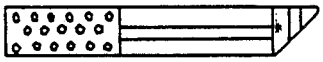
FIG. 8C
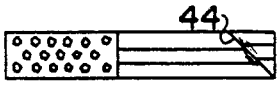
FIG. 8D
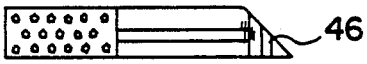
FIG. 8E
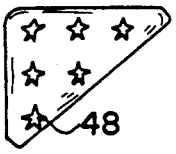
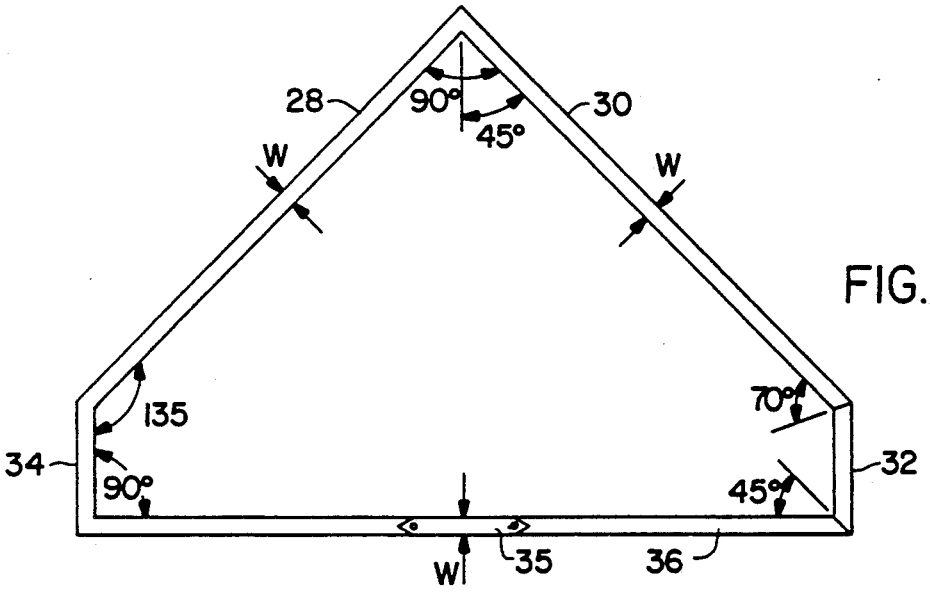
FIG. 9

DISPLAY CASE FOR A FOLDED MEMORIAL FLAG

FIELD OF THE INVENTION

This invention relates to a display case specifically suited for the display of a folded memorial flag.

BACKGROUND OF THE INVENTION

Upon the death of a service man, service woman or distinguished government official, a folded memorial flag is presented to the surviving spouse or next of kin. Due to the lack of a proper display case, recipients of the folded memorial flag often place the folded memorial flag in a storage location which is not only hidden from view but also susceptible to deterioration.

SUMMARY OF THE INVENTION

The present invention is directed at providing a self supporting display case which displays a folded memorial flag so as to be clearly visible. In other words, the present invention is directed at providing a display case for a memorial flag which centers the memorial flag between a transparent facing and an opaque backing number. Furthermore, centering is achieved by compression of the folded memorial flag between the transparent facing and the opaque backing member such that the front face of the folded memorial flag is in full contact with the transparent facing so as to ensure a complete display of the flag's front face and avoid shadows or the like which could degrade the display of the memorial flag. The present invention also essentially seals the folded memorial flag within the casing such that the memorial flag is less susceptible to deterioration and/or staining. The self supporting nature of the display case allows for positioning of the display case above a mantle, table or shelving.

A preferred embodiment of the present invention includes siding means extending essentially perpendicular to the peripheral edge of the opaque backing member. The transparent facing is attached along its periphery to the free end of the siding means so as to provide an essentially sealed hollow interior. Preferably, the siding means includes a step shoulder along its inner surface against which the outer edge of the transparent facing is in contact. Securement means is provided to secure the backing member to the siding means. Preferably the securement means is releasable so as to enable occasional removal of the folded memorial flag from the casing. Alternatively, the siding means, backing member and facing can be secured together in a manner which provides a completely sealed arrangement. However, for purposes of the present invention, it is preferable that the securement means be easily detached so as to enable occasional removal of the flag.

The securement means is also preferably difficult to detect on the exterior of the siding. For this reason, a clear transparent adhesive member is preferred. Alternatively, screws or the like could be used, but are considered less preferable in view of the added work necessary for removal. In an alternate embodiment of the present invention, a hinge member or members are provided along the contact edge between the backing member and a planar support section of the siding means. In addition to the hinge member or members, releasable attachment means are provided to prevent pivoting of the backing member until pivoting is deemed desirable. For example, a pair of adhesive strips can be provided.

The distance between the inside surface of the transparent facing and the inside surface of the secured backing member is such that the folded memorial flag is compressed between the two surfaces and maintained in a centered position. The centered position ensures that the opaque backing member provides a visible strip which surrounds the periphery of the memorial flag. In a preferred embodiment, the visually distinguishable strip is represented by the natural grain of a wooden backing member.

The casing is preferably of a pentagonal shape with the siding means including two elongated side sections joined at their ends to form an apex; two shorter side sections extending downwardly from the free end of a respective one of the elongated side sections; and a lower planar bottom which is joined to the free end of the shorter side sections. Although a folded memorial flag has a generally triangular appearance, often one or more of the corners do not extend to a point, but, rather, is in the form of a flattened edge due to the bunching of the folded material. Accordingly, the pentagonal shape of the present invention takes this into account by utilizing the shorter side sections in position near two of the corners of the folded flag while also maintaining symmetry of appearance.

In an alternate embodiment, the memorial flag is compressed between two transparent plates and the siding means includes two flanges against which the transparent plates are compressed. To facilitate removal, it is contemplated that two or more sections of the siding means be releasably affixed to one another.

BRIEF DESCRIPTION OF THE DRAWINGS

Additional features and advantages of the present invention will be made more apparent from the following description with reference to the accompanying drawings in which:

FIG. 6 illustrates an alternate embodiment of the present invention having a hinged backing member;

FIGS. *7a–7c* illustrate the side sections which are joined together to form the siding means of the present invention; and FIGS. *8a–8e* illustrate the proper manner of folding a memorial flag.

FIG. 9 shows the preferred angular relationship of an embodiment of the present invention.

DETAILED DESCRIPTION OF THE PREFERRED EMBODIMENTS

Figure 1:
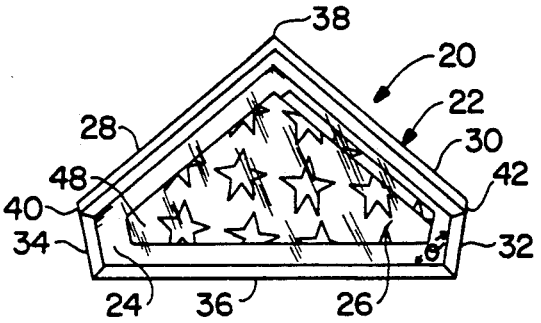
FIG. 1 is a front view of the display case of the present invention with a folded memorial flag centrally positioned therein.

FIG. 1 illustrates a front view of a preferred embodiment of the present invention wherein display casing 20 includes siding means 22, transparent facing 24 and a folded memorial flag 26 positioned therein. Siding means 22 includes elongated side sections 28 and 30, shorter side sections 32 and 34 and planar support section 36. Elongated side sections 28 and 30 are joined together at one end (e.g., by adhesive) to form upper apex 38. Lower ends 40, 42 of side sections 28, 30 are joined to lower side sections 32, 34. Lower sides sections 32, 34 extend downwardly and incline towards one another such that angle theta is formed with respect to planar support member 36. In a preferred embodiment angle theta is about 90 to 100° with the 100° arrangement being illustrated in FIG. 1. Planar support member 36 is joined at its ends to respective ones of lower side sections 32, 34. As shown in FIG. 1, folded memorial flag 26 is centrally positioned within the interior of casing 20.

FIGS. 8*a*–8*e* illustrate the proper way to fold a memorial flag. With respect to the folding of an American flag, FIG. 8*a* illustrates that the flag is folded in an accordion like fashion so as to have an upper surface containing a portion of the field and stripes extending off that portion of the field. FIG. 8*b* illustrates the second step of bringing the lower stripe corner to the upper edge so as to form a triangle. FIG. 8*c* illustrates the bringing of the outer point inward on the upper edge to form a second triangle. As illustrated in FIG. 8*d*, an additional triangle is formed by folding the flag about edge 44 (FIG. 8*c*) to form the additional triangle section 46. This folding process is continued until the entire length of the flag is folded. When the flag is completely folded only the blue field is visible and the folded flag has a generally triangular shape simulating a cocked hat. As shown in FIG. 1 the thickness of the folds often tends to create a flattened side edge such as that designated 48. The pentagonal shape of the display case 20 takes this in to account through the use of side sections 32, 34 which compliment the shape of the folded flag by providing a continuous and conforming visibility strip about the periphery of the folded flag.

Figure 2:
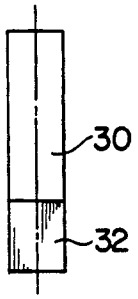
FIG. 2 is a side view of that which is shown in FIG. 1.

FIG. 2 shows a side view of that which is shown in FIG. 1. FIG. 2 illustrates side sections 30 and 32. The opposite side would have the same configuration.

Figure 3:
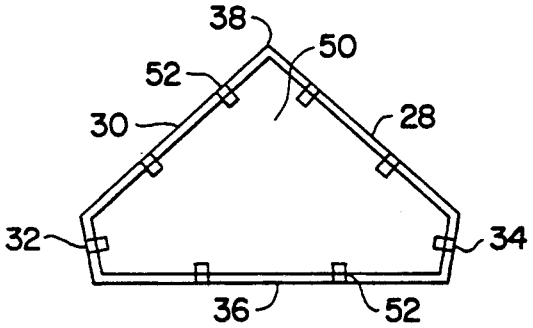
FIG. 3 is a back view of that which is shown in FIG. 1.

FIG. 3 shows the back of that which is shown in FIG. 1. Backing member 50 is secured to siding means 22 by way of securement means 52 which, in a preferred embodiment, constitutes a plurality of transparent adhesive strips. This allows for not only the initial insertion of the memorial flag into the casing, but also the freedom of occasional displacement of the memorial flag out of the casing. Alternatively, the backing member can be adhesively secured to the siding means so as to provide a permanent and sealed connection therebetween. Backing member 50 is preferably opaque so as to enhance the visual disparity between the backing member, folded memorial flag, and facing. The present invention also contemplates the utilization of an additional transparent facing instead of the opaque backing member.

Figure 4:
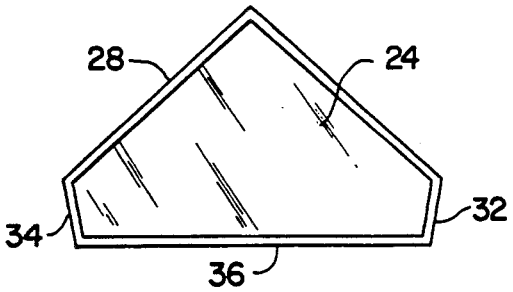
FIG. 4 is a front view of that which is shown in FIG. 1 with the folded memorial flag removed.

FIG. 4 illustrates the front view of the embodiment in FIG. 1 without the folded memorial flag in place. As illustrated, front facing 24 is transparent. Suitable materials for front facing 24 include a glass plate or a transparent or translucent plastic sheet. Facing 24 should also be sufficiently inflexible so as to provide the compression necessary to maintain folded memorial flag in a central position as explained further below.

Figure 5A:
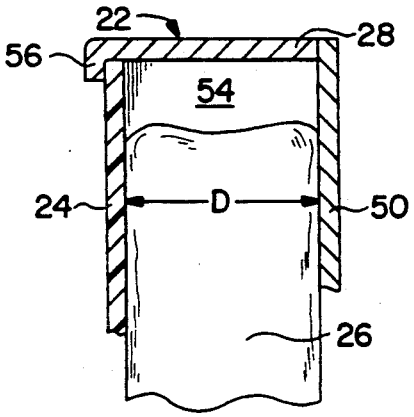
FIG. 5A is a partial cross-sectional view of that which is shown in FIG. 1 and illustrating the compressive nature of the front facing and backing member with respect to a folded memorial flag.

FIG. 5A represents a partial cross-sectional view taken along line V—V shown in FIG. 1. As illustrated in FIG. 5A, folded memorial flag 26 is positioned between backing member and front facing 24 such that there is space 54 between the periphery of flag 26 and the interior of siding means 22. Flange 56 is provided in the forward end of siding means 22 such that a stepped shoulder is provided which abuts facing 24. The distance D between the inner surface of facing 24 and the inner surface of backing 50 is sufficient to maintain memorial flag 26 frictionally affixed therebetween. A suitable distance D for the purposes of the present invention is about 3.5 to 3.75 inches.

Figure 5B:
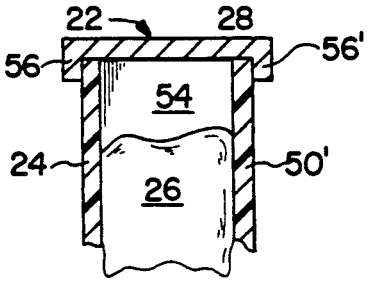
FIG. 5B is a partial cross-sectional view of an alternate embodiment having two transparent facings.

FIG. 5*b* shows the alternate embodiment discussed above wherein, rather than a facing member and opaque backing member, there is provided facing member 24 and transparent backing member 50'. With this arrangement, there is provided additional flange 56' so as to further ensure the compressive fit of flag 26 by providing an additional abutment against which backing member 50' is compressed. For assembly purposes in this embodiment, any two or more sections of siding means 22 can be made releasably attachable. For example, planar support member 36 can be affixed in place last after the rest of the casing is assembled and memorial flag 26 is pushed into position between the facing and backing member. The planar support member can then either be permanently affixed or releasably attached (e.g., a hinge at one end and an adhesive tab at the other end) to enable future removable of the flag.

FIG. 6 shows an alternate embodiment wherein securement means 52 includes hinge 60 and adhesive tabs 62, 64. In this embodiment, hinge 60 is affixed to backing member 50 and planar support member 36 such that backing member 50 is free to rotate away from siding means 22. Adhesive tabs 62 and 64 are provided to maintain the backing member in an upright position and in position to provide the compression necessary to maintain flag 26 in position.

FIG. 7*a*–7*c* illustrate sections 28, 34, and 36 of siding means 22 as well as their preferred length ratios. Siding sections 30 and 32 would be equal to their opposite side equivalents. The width W of each of the siding sections is preferably about 3 inches. The length to width ration of base 36 is about 8.25:1.

FIG. 9 illustrates the preferred angular relationship among the different side section of the casing. As shown in FIG. 9, the pentagonal shaped casing 20 has short side sections 32, 34 arranged perpendicular with respect to planar support section 36. Also, the adjoining end edges are arranged at a 45° orientation. Elongated side section 30 and shorter side section 32 are joined together to form a 135° angle and the angle cut at the ends of the combined sections is at a 70° orientation as shown. The apex of display casing 20 forms a 90° angle with the ends of the two adjoining elongated side sections having a 45° angle cut.

FIG. 9 further illustrates the width W of each of the side section is about equal. A preferred width is about 0.5 of an inch to 1 inch which provides a sufficient mounting surface for name plate 35.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A casing for displaying a folded memorial flag comprising:

a backing member having a peripheral edge;

siding means extending essentially perpendicular to the peripheral edge of said backing member, said siding means having a rearward edge and a forward edge;

securement means for securing the rearward edge of said siding means to said backing member;

a transparent front facing having a peripheral edge in contact with said siding means such that said transparent facing is closer to the forward edge of said siding means than to the rearward edge of said siding means; and said siding means, backing member, and transparent front facing being dimensioned and arranged so as to compress the memorial flag in a fixed position between said facing and backing member, and said siding means including a planar support section and said securement means includes a hinge member pivotably connecting said planar support section to said backing member, and said securement means including a fastening device for releasably securing said backing member to said siding means so as to prevent pivoting of said backing member about said planar support section.

2. A casing as recited in claim 1, wherein said siding means is pentagonal in shape having a pair of upper siding sections meeting at an apex, a pair of lower and shorter siding sections affixed to a respective end of said upper siding sections and extending downwardly, and a planar support section having ends in securement with a respective one of said lower and shorter siding sections.

3. A casing as recited in claim 2, wherein said lower and shorter side sections slope inwardly towards one another.

4. A casing as recited in claim 1, wherein said securement means includes means for releasably securing said backing member to said siding means.

5. A casing as recited in claim 4, wherein said means for releasably securing said backing member to said siding means includes adhesive strips.

6. A casing as recited in claim 5, wherein said adhesive strips are essentially transparent.

7. A casing as recited in claim 1, wherein said planar support section is sufficiently wide to support said case on an underlying surface free from additional support means.

8. A casing as recited in claim 1, wherein said casing is self supporting with a planar base having a length to width ratio of about 8.25:1.

9. A casing as recited in claim 1, wherein said siding means is about 3 inches in width.

10. A casing as recited in claim 1, wherein the distance between said transparent facing and backing member is about 3.5 to 3.75 such that said folded memorial flag is affixedly centered.

11. A casing as recited in claim 11, wherein said backing member is opaque.

12. A casing as recited in claim 1, wherein said backing member is opaque.

13. A casing as recited in claim 1, wherein said siding means includes an inwardly extending peripheral flange and said facing being in abutment with said flange.

14. A casing as recited in claim 1, wherein said siding means, backing member, and transparent facing are dimensioned and arranged to fix the memorial flag in a centered position within said casing whereby there is provided a space between the periphery of the memorial flag and said siding means.

15. A casing as recited in claim 1, wherein both said front facing and backing member are transparent.

16. A casing as recited in claim 15, wherein said siding means includes a flange at a forward edge and a rearward edge such that a stepped shoulder is provided at the forward and rearward end of said siding means which are adapted for contact with the periphery of said front facing and backing member.

17. A casing as recited in claim 1 wherein said siding means has a forward edge width which is equal about the entire peripheral edge of said front facing.

18. A casing recited in claim 17 wherein said forward edge width is from 0.5 of an inch to 1 inch and said casing further comprising a plate affixed to said forward edge width.

* * * * *